US005809862A

United States Patent [19]

Dallman

[11] Patent Number: 5,809,862

[45] Date of Patent: Sep. 22, 1998

[54] FLOTATION CONTROL SYSTEM

[76] Inventor: Jimmie J. Dallman, 3709 99th Dr. S.E., Everett, Wash. 98205

[21] Appl. No.: 673,138

[22] Filed: Jul. 1, 1996

Related U.S. Application Data

[60] Provisional application No. 60/001,902, Aug. 4, 1995.

[51] Int. Cl.[6] ..... F15B 11/10

[52] U.S. Cl. ..... 91/26; 91/31; 91/390; 91/433; 91/446

[58] Field of Search ..... 91/446, 31, 433, 91/26, 390; 56/15.2; 172/239, 4

[56] References Cited

U.S. PATENT DOCUMENTS

| | | | |
|---|---|---|---|
| 2,687,606 | 8/1954 | Greer, Sr. et al. | 56/15.2 |
| 2,755,721 | 7/1956 | Rusconi | 172/4 |
| 2,832,276 | 4/1958 | Heitshu | 172/239 |
| 2,887,165 | 5/1959 | Heitshu et al. | 172/239 |
| 2,913,878 | 11/1959 | Rue | 172/4 |
| 2,933,838 | 4/1960 | Rockwell | 172/239 |
| 3,592,216 | 7/1971 | McMillen | 91/433 |
| 3,949,539 | 4/1976 | Cartner | 56/15.2 |
| 3,976,097 | 8/1976 | Brakel | 91/446 |
| 4,020,867 | 5/1977 | Sumiyoshi | 91/433 |
| 4,401,009 | 8/1983 | Zeuner et al. | 91/31 |
| 4,579,038 | 4/1986 | Winter | 91/31 |
| 4,622,803 | 11/1986 | Lech | 91/433 |
| 5,024,140 | 6/1991 | Gage | 91/31 |
| 5,460,001 | 10/1995 | Kato et al. | 91/446 |

FOREIGN PATENT DOCUMENTS

| | | | |
|---|---|---|---|
| 1000616 | 3/1983 | U.S.S.R. | 91/31 |
| 82/02230 | 7/1982 | WIPO | 91/433 |

*Primary Examiner*—Sheldon Richter
*Attorney, Agent, or Firm*—Donna J. Thies

[57] ABSTRACT

A flotation control system for controlling the boom of a tractor or brush cutting machine. Three hydraulic valves operate together and work in conjunction with the existing main valve of the tractor or brush cutting machine to provide flotation control or automatic movement up and down of the boom in response to ground surface variations. The system also allows the amount of weight that the cutter or other attachment exerts against the ground to be increased or decreased. The first valve is a flow control valve or a flow restricting or dividing valve that divides hydraulic flow from the pump of the tractor to the flotation control system. The second valve is a pressure reducing valve that provides the general operation of the flotation control system. The third valve is a directional valve and functions as an on/off for the flotation control system. The third valve allows a float mode by moving a cylinder which is already present in the tractor hydraulic system up or down to control movement of the boom up or down. The system is used in either a closed center or open center hydraulic system. A method of providing flotation control for controlling the boom of a tractor or brush cutting machine is also disclosed.

20 Claims, 12 Drawing Sheets

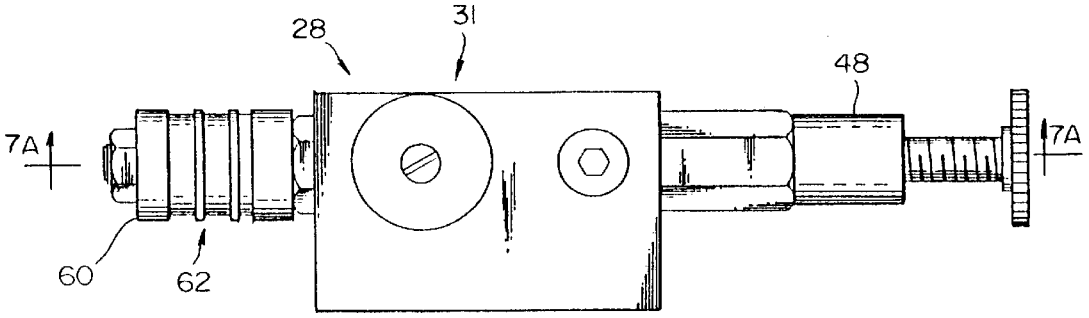
FIG. 7
FIG. 7A
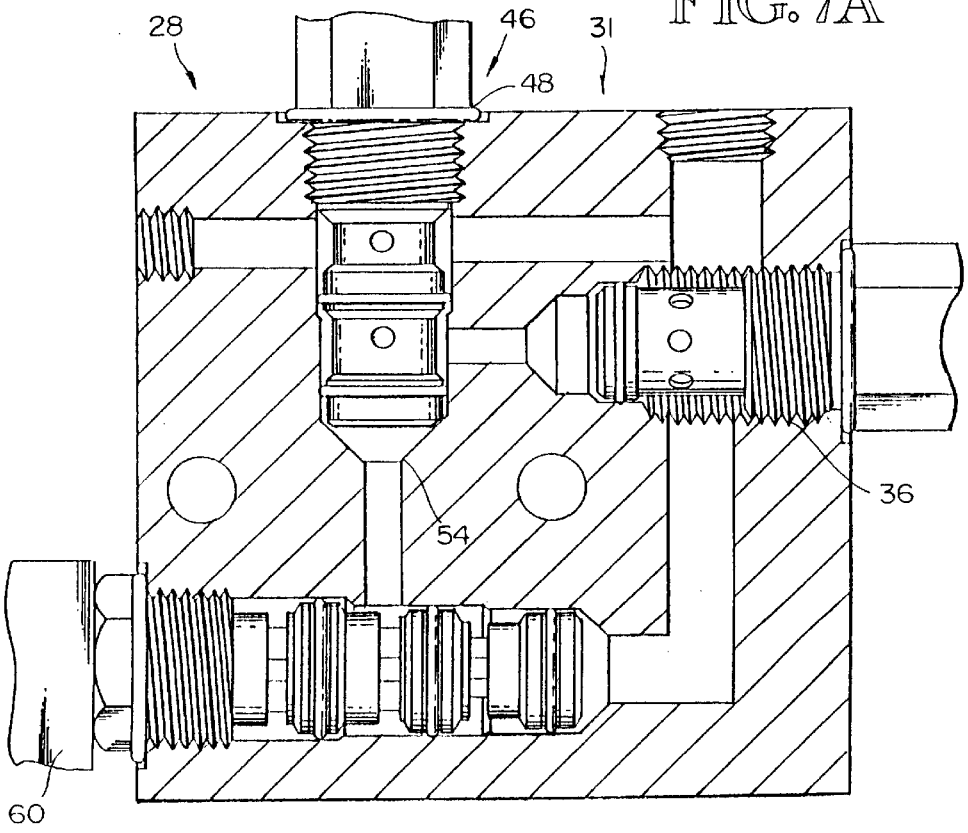

FLOTATION CONTROL SYSTEM

This application claims the benefit of U.S. Provisional application Ser. No. 60/001902, filed Aug. 4, 1995.

BACKGROUND OF THE INVENTION

In brush cutting applications wherein a tractor is adapted to have brush cutting attachments such as a rotary cutter, flail cutter or the like, problems occur with the cutter being positioned at the same level relative to the tractor. In the prior art, as the ground level changes the cutter either moves above the brush to be cut in the case of a depression in the ground being encountered or the cutter dips into the ground upon encountering a hill or earth mound. In addition to not providing an even cut of brush, such a system produces much stress on the tractor and on the operator when the cutting attachment and hence the tractor are jarred by uneven areas of ground. It is therefore desired that a flotation control system be devised whereby the brush cutter attachment is allowed to float and compensate its parallel position relative to the ground.

U.S. Pat. No. 2,687,606 to Greer, Sr., et. al. discloses a mower attachment for tractor that is driven off the tractor PTO.

U.S. Pat. No. 2,755,721 to Rusconi discloses an automatic depth control system for agricultural implements which uses a hydraulic system to control the depth of earth engagement of farm implement attachments to a tractor.

U.S. Pat. No. 2,832,276 to Heitshu discloses a hitch device for a tractor that uses a hydraulic system to control the position of an implement generally parallel to the ground regardless of the pitch of the tractor.

U.S. Pat. No. 2,887,165 to Heitshu, et al. discloses a hitch device for a tractor that uses a hydraulic system to control depth adjustment of an implement using certain portions of the tractor power lift apparatus.

U.S. Pat. No. 2,913,878 to Rue discloses a valve system which maintains a member in a selected position relative to a reference surface or element.

U.S. Pat. No. 2,933,838 to Rockwell discloses an automatic depth control for an implement that will control the depth penetration of a blade or other implement as it traverses over the ground.

U.S. Pat. No. 3,949,539 to Cartner discloses a mowing attachment for a tractor with a horizontally and vertically swinging telescopic boom. A hydraulic circuit allows relative movement between a piston and a cylinder when the cutter strikes an obstruction.

U.S. Pat. No. 4,579,038 to Winter discloses a depth control valve for agricultural implements that uses a hydraulic system with a sensor responsive depth regulator that utilizes the existing hydraulic system of the tractor.

SUMMARY OF THE INVENTION

In order to overcome problems inherent in the prior art, there has been devised by the present flotation control system a hydraulic means to control the boom of a tractor or brush cutting machine. The flotation control system allows the boom to be automatically moved up and down in response to ground surface variations. It also allows the machine operator to increase or decrease the amount of the weight of the cutter or other attachment that rests on the ground. A control lever. positioned in the cab of the tractor or brush cutting machine and associated with the flotation control system has neutral, up, and down positions that include an electronic on/off button operated manually. The on/off button allows the flotation control system to be taken in and out of service. When the system is in the on mode the boom will automatically follow the ground surface and when the system is in the off mode the operator has manual control of the boom. Oil flow and oil pressure control valves associated with the system allow the operator to set and/or adjust the speed and sensitivity of the system. The flotation control system of the present invention can be used on a single control valve or multiple valve system of a tractor or other piece of machinery.

The flotation control system of the present invention comprises three hydraulic means in the form of valves which operate together and work in conjunction with the main valve of the tractor or brush cutting machine to provide flotation control. This can be accomplished in either a closed center or open center hydraulic system. The first valve is a flow control means restricting or flow dividing valve that divides hydraulic flow from the pump to the flotation control system. A second valve is a pressure reducing valve that provides the general operation of the present flotation control system. A third valve is a directional valve and functions as an on/off for the flotation control system. The third valve creates a float mode in the flotation control system by moving a cylinder which is already present in the tractor hydraulic system up or down to control movement of the boom up or down.

It is therefore an object and advantage of the present flotation control system for a tractor to provide a system that allows a cutter or other tractor attachment to float in even parallel relationship over an uneven ground surface.

It is another object and advantage of the present flotation control system to provide an even cut of brush.

It is yet another object and advantage of the present flotation control system to reduce stress on the tractor and operator by reducing jarring movements caused by the tractor attachments hitting uneven ground surfaces.

It is still yet another object and advantage of the present flotation control system to allow compensations in the pressure asserted against the ground by a tractor attachment to be controlled within the cab of the tractor.

It is still yet another object and advantage of the present flotation control system to provide a flotation control system in the form of a valve assembly housed in a single block to be used as an add on feature to an existing tractor.

It is still yet another object and advantage of the present flotation control system to provide such a system that can be added separately in pieces to any part of an internal tractor operating system.

BRIEF DESCRIPTION OF THE DRAWINGS

FIG. 7 is a top plan view of the first embodiment of the hydraulic valve system of the present flotation control system utilizing a closed center system.

FIG. 7A is a cross sectional view taken through line 7A—7A of FIG. 7 showing the first embodiment of the hydraulic valve system of the present flotation control system utilizing a closed center system.

DESCRIPTION OF THE PREFERRED EMBODIMENT

Figure 1:
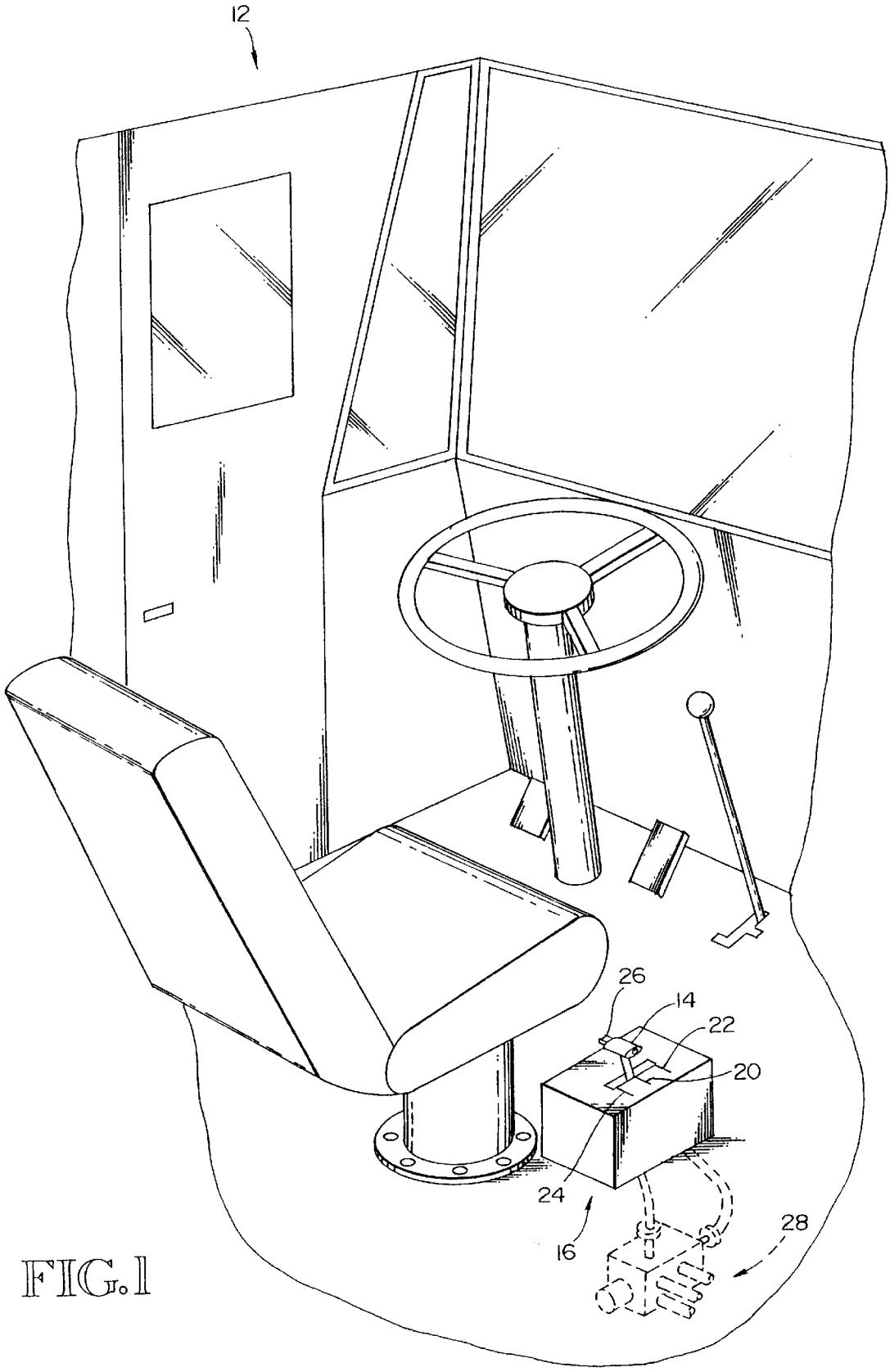
FIG. 1 is an environmental view showing how the present flotation control system is utilized in a typical brush cutting machine.
Figure 1A:
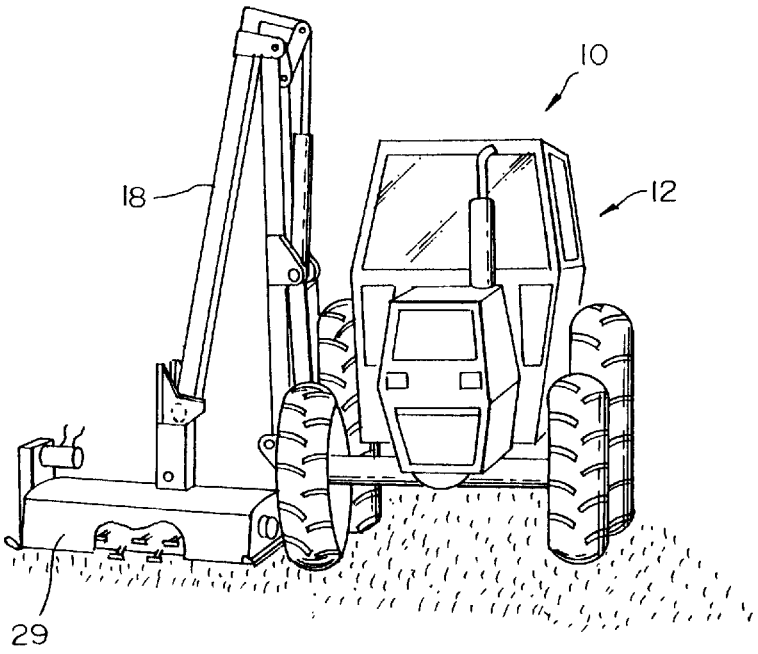
FIG. 1A is an environmental view showing how the present flotation control system is utilized in a typical brush cutting application.

Referring now to the drawings in general and in particular to FIGS. 1 and 1A of the drawings there is shown an environmental view of the present flotation control system as it is utilized in a brush cutting machine. The brush cutting machine is shown generally by the number 10. Positioned inside the cab 12 of the brush cutting machine 10 is a control lever 14 associated with the present flotation control system shown generally by the number 16. The control lever 14 has the general appearance of a standard gear shift and is used to move the boom 18 of the brush cutting machine 10 up and down. For this purpose, the control lever 14 has associated therewith a neutral position 20, an up position 22 and a down position 24. The control lever 14 also includes an electric on/off button 26 that is operated manually, allowing the flotation control system 16 to be taken in and out of service.

To operate the present flotation control system 16, the on/off button 26 is pressed or switched to on whereupon the boom 18 of the brush cutting machine 10 will automatically follow the ground surface by means of the hydraulic valve system 28 as shown generally in FIGS. 4, 5, 6, and 6A and as described hereinafter. When the flotation control system 16 is in the off mode the operator maintains manual control of the boom 18 as it is conventionally operated. Generally, oil flow and oil pressure control valves associated with the hydraulic valve system 28 and as will be described hereinafter allow the operator to set and/or adjust the speed and sensitivity of the system. Thus, by engaging the on button 26 and moving the control lever 14 inside the cab 12, the operator is in detailed, automatic control of the vertical position of the boom 18 and hence the horizontal position of an attachment 29 to the boom 18 relative to a ground surface. The hydraulic valve system 28 associated with the present flotation control system 16 operates to sense changes in pressure of an attachment 29 against a ground surface and to adjust the pressure accordingly, based on a setting that has been made using the control lever 14. The changes in pressure that the hydraulic valve system 28 will sense occur due to depressions or elevations encountered in the ground surface.

Generally, in the present invention three valves as will be described hereinafter, work together and operate in conjunction with the main four way valve 30 of the tractor or brush cutting machine 10 as shown schematically in FIGS. 2 and 3 to accomplish the flotation control for a tractor or brush cutting machine 10.

Figure 2:
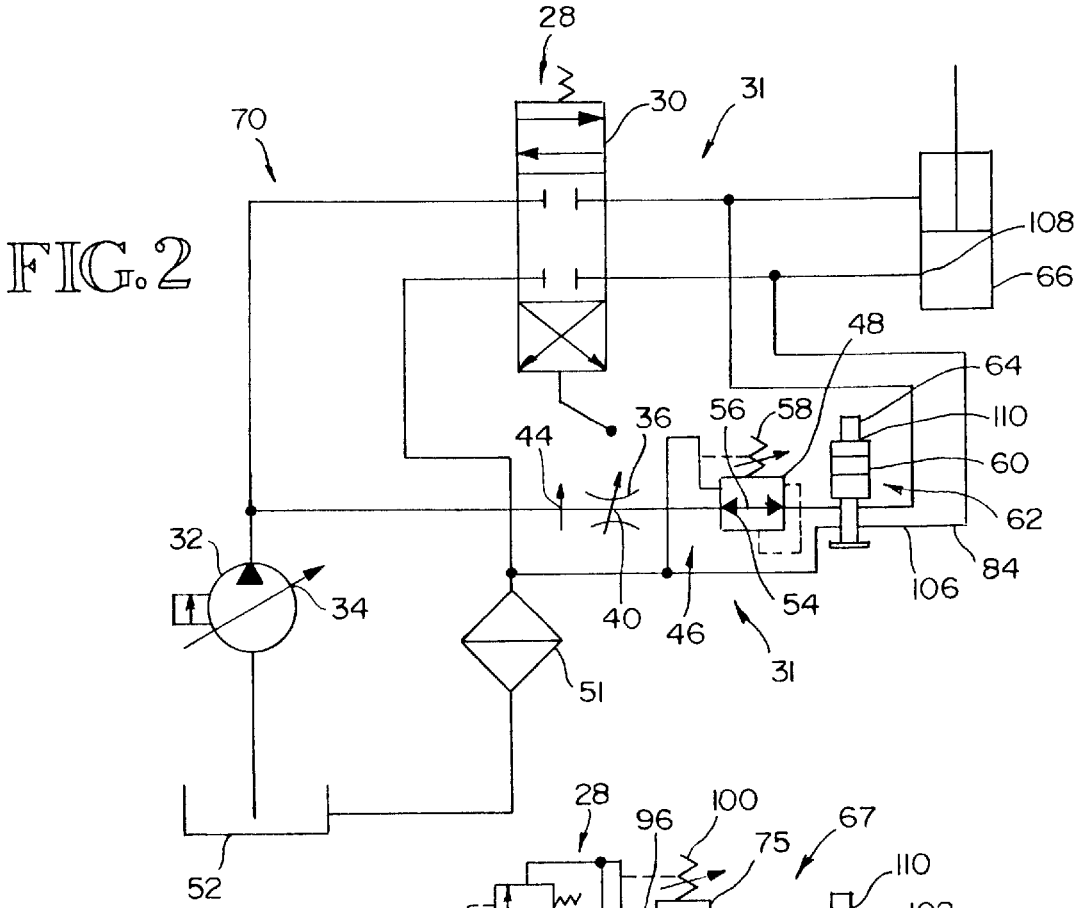
FIG. 2 is a schematic view of a first embodiment of the present flotation control system utilizing a closed center system which is a piston or demand system which only pumps an amount of hydraulic fluid that is necessary to make the flotation control system work.

Referring now to FIG. 2 of the drawings there is shown a schematic view of a first embodiment of the present flotation control system 16 utilizing a closed center system 31 which has a variable displacement hydraulic pump 32.

Generally, in the first embodiment or closed center system 31 of the present flotation control system a piston pump 34 is most often used as the variable displacement hydraulic pump 32 of the tractor or brush cutting machine 10.

Figure 8:
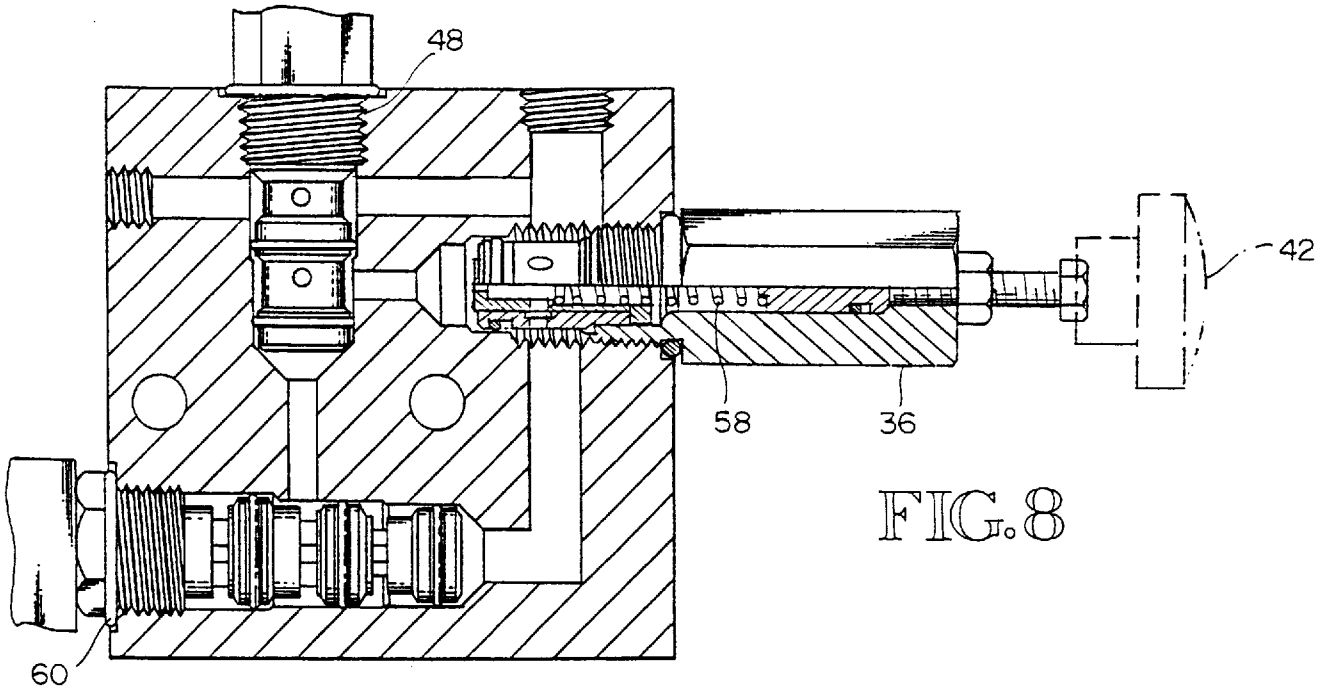
FIG. 8 is a cross-sectional view taken through line 8—8 of FIG. 4 showing the flow control valve of the first embodiment utilizing a closed center system.

In the first embodiment of the flotation control system 16 utilizing a closed center system 31 the first valve is a flow control valve 36, as seen most clearly in FIG. 8, that provides hydraulic flow control that is adjustable and pressure compensated. The rate of hydraulic flow through the flow control valve 36 is determined by the size of the orifice 40, as seen most clearly in FIG. 2. The orifice 40 is adjusted by positioning the indicator dial 42 as seen most clearly in FIG. 4, and can be set to provide variable flow including no flow, thus providing a wide range of speed adjustments for varying conditions. Flow adjustment by means of varying the orifice 40 size offers an advantage over flow adjustment by changing a spring load in that a fixed pressure drop is maintained across the orifice 40 with the use of the pressure compensated piston 44.

Figure 9:
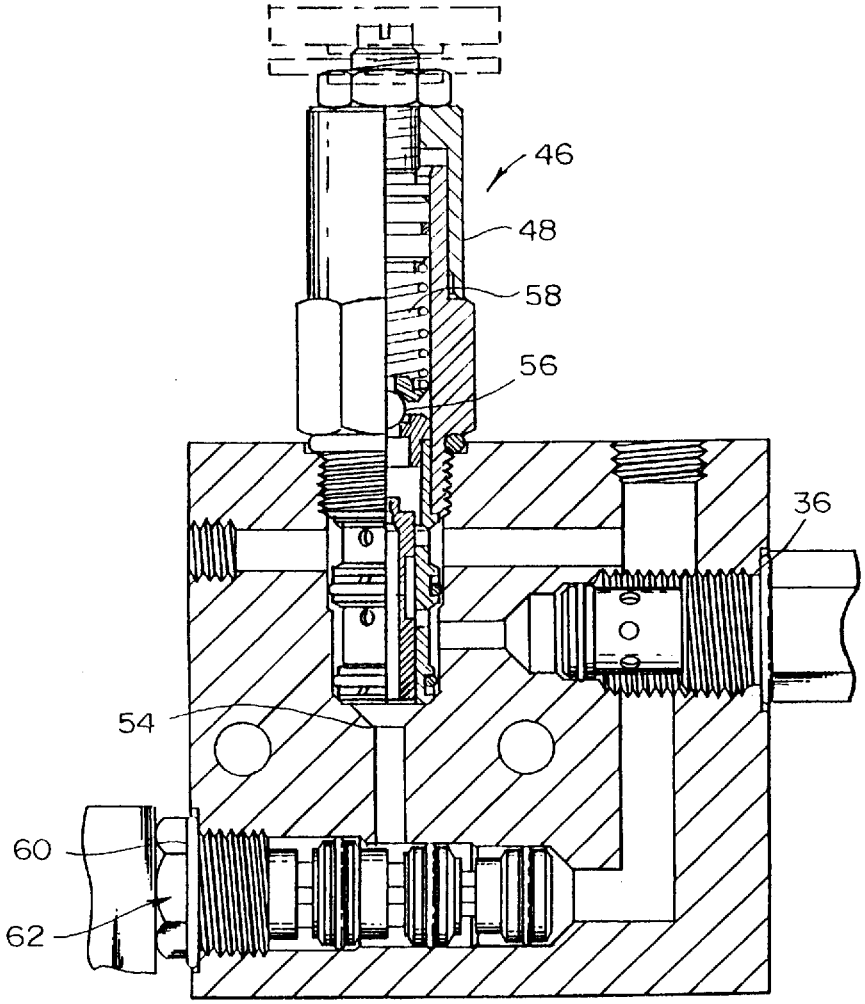
FIG. 9 is a cross-sectional view taken through line 9—9 of FIG. 4 showing the pressure reducing valve of the first embodiment utilizing a closed center system.
Figure 9A:
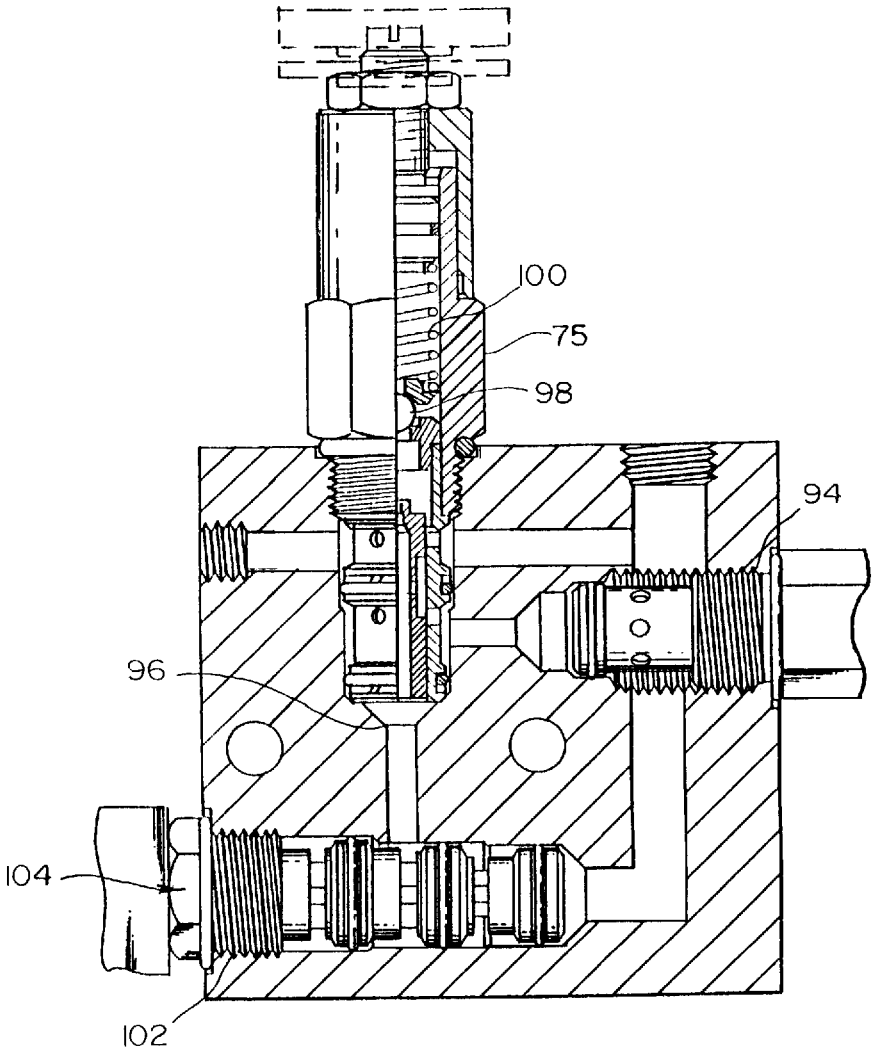
FIG. 9A is a cross-sectional view taken through line 9A—9A of FIG. 5 showing the pressure reducing valve of the second embodiment utilizing an open center system.

Hydraulic flow from the flow control valve 36 is then directed to a second valve, a pressure reducing means 46 that is adjustable. The pressure reducing means 46 in the form of a valve 48, as seen most clearly in FIG. 9, allows the brush cutter or other attachment 29 as seen in FIG. 1A to have its pressure against the ground sensed and compensated. Thus, as a cutter or other attachment 29 presses against the ground any changes in the ground level such as a depression or hill, is sensed and the cutter or attachment 29 is controlled to float across the upper surface of the ground. Generally, when the pressure presented to the attachment 29 becomes too great, as when encountering a hole or earth mound, the pressure relief or pressure reducing valve 48 of the present flotation control system 16 allows the hydraulic pressure of the flotation control system 16 to bypass the flotation control system 16 and return to the main tractor control valve 30; or through the filter 51 of the main tractor hydraulic system, and to the main tractor hydraulic tank 52, as seen in FIG. 2. More specifically, in the first embodiment of the present invention utilizing a closed center system 31, as seen in FIG. 2, hydraulic flow in the pressure reducing valve 48 is allowed between the valve inlet 54 and the valve ball 56 at a predetermined level of hydraulic pressure. Thus, the valve ball 56 is held closed by an adjustable mechanical spring 58, the spring force holding the valve ball 56 closed is opposed by hydraulic pressure tending to open the valve ball 56. When this predetermined level of hydraulic pressure between the valve inlet 54 and valve ball 56 is exceeded, pressure at the valve ball 56 will cause the valve ball 56 to open a small distance, allowing a small part of the oil in the flotation control system 16 to escape and return to the main tractor hydraulic tank 52.

Figure 11:
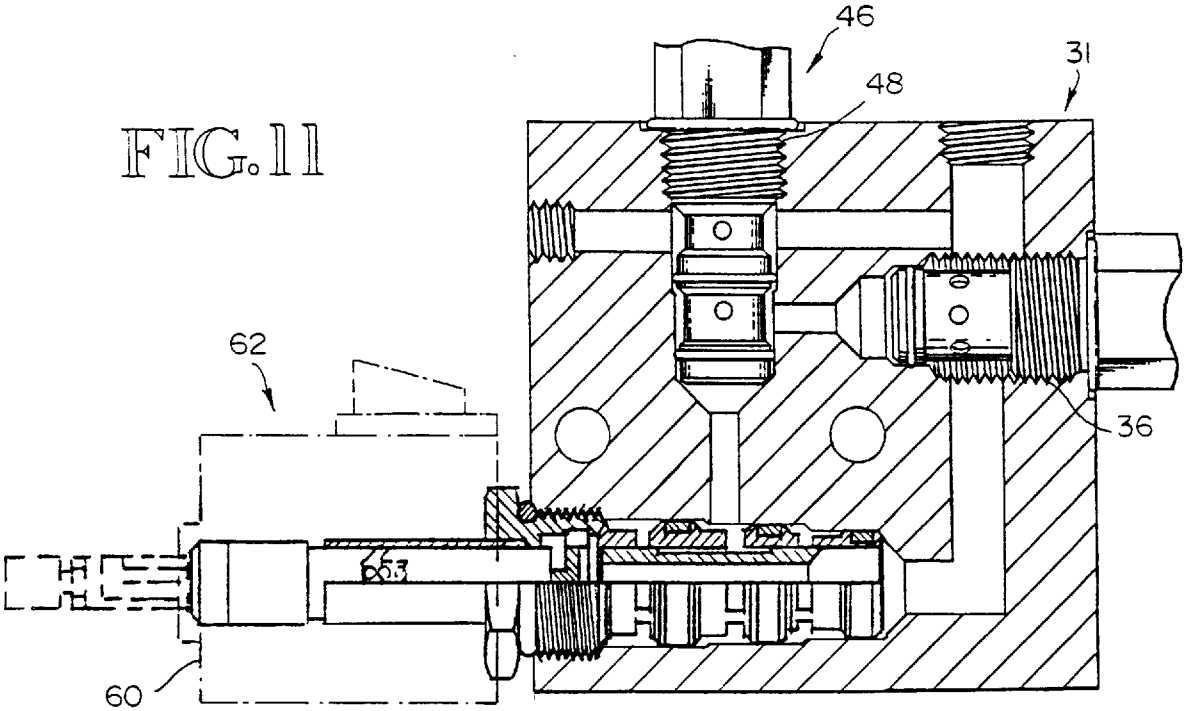
FIG. 11 is a cross-sectional view taken through line 11—11 of FIG. 4 of the directional valve of the first embodiment utilizing a closed center system.

A third valve directional valve 60 operates an operational on/off means 62 for the first embodiment of the present invention utilizing a closed center system 31. The directional valve for the closed center system is seen most clearly in FIG. 11. More specifically, the directional valve 60 has two positions, on or off. In the de-energized mode with the valve magnet 64, as seen in FIG. 2, de-energized or off, the four way directional valve 60 blocks all flow from the pressure reducing valve 48, also as seen in FIG. 2. When the valve magnet 64 is energized the hydraulic flow is connected to the hydraulic cylinder 66, as seen in FIG. 2, of the pre-existing tractor system thereby allowing the pressure reducing valve 48 to function as described hereinbefore.

Figure 3:
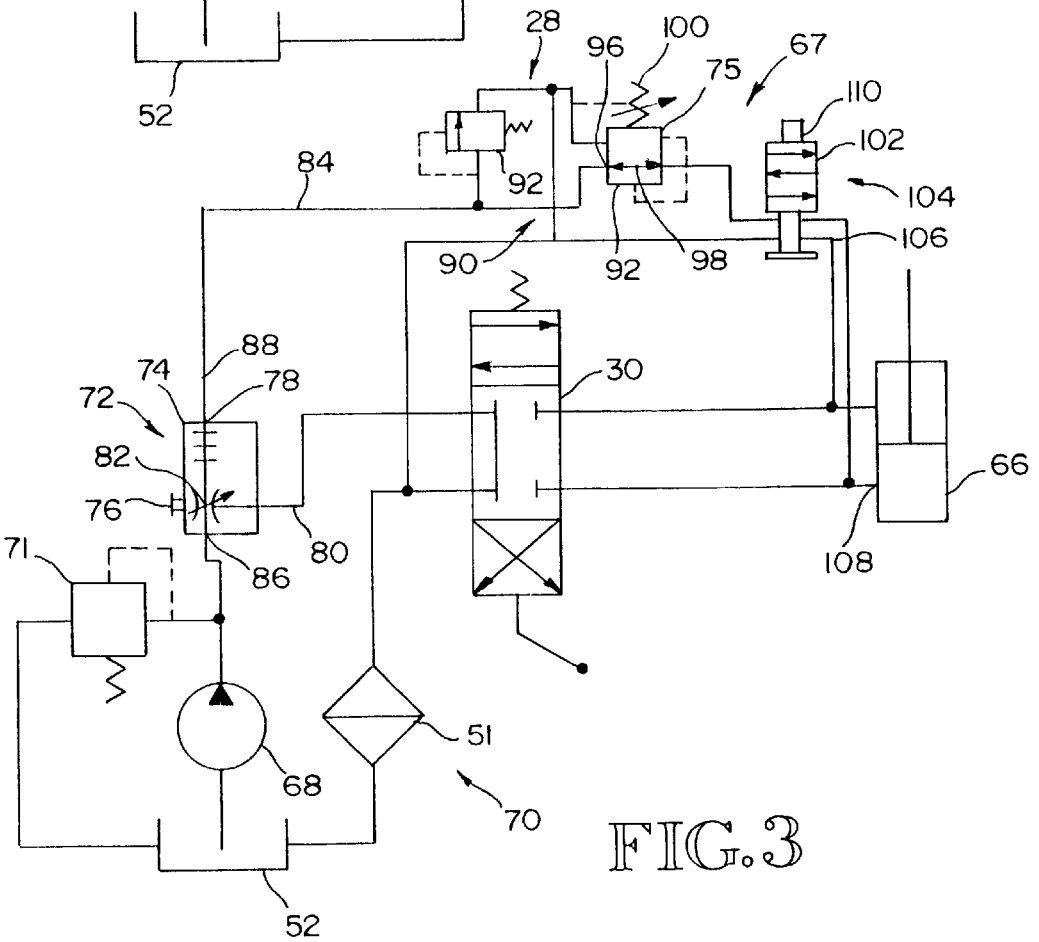
FIG. 3 is a schematic view of a second embodiment of the present flotation control system utilizing an open center system which is gear driven to provide constant, positive displacement of hydraulic fluids.
Figure 4:
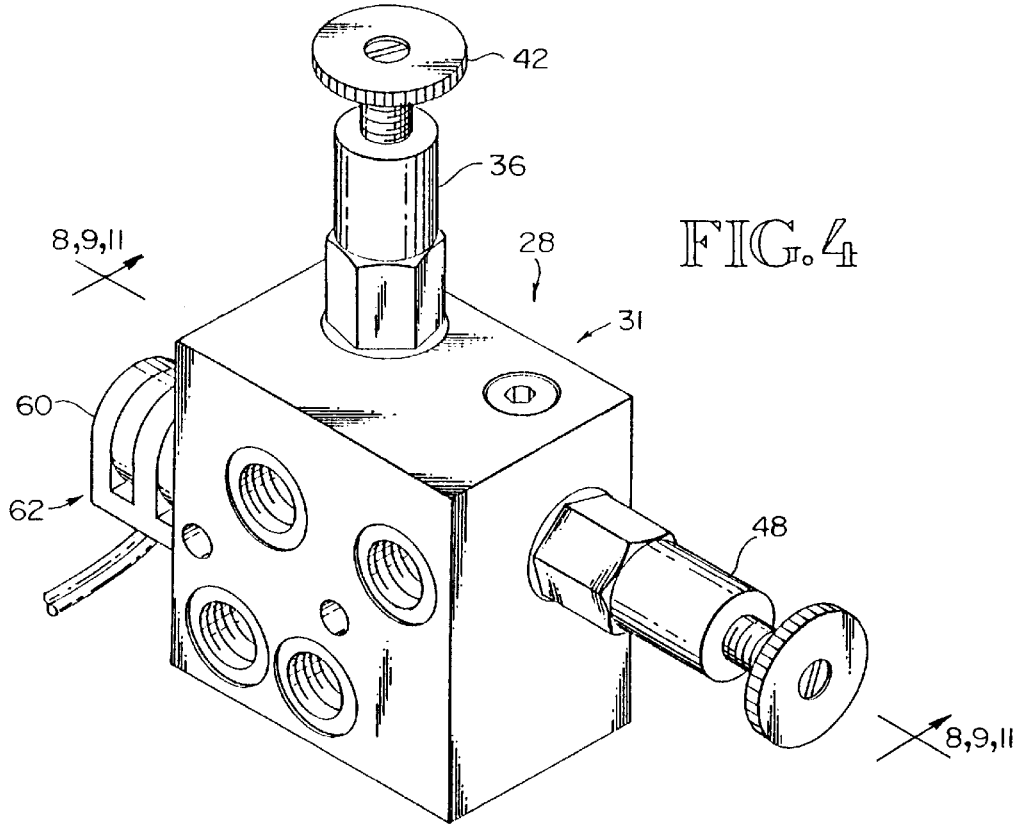
FIG. 4 is a perspective view of the first embodiment of the hydraulic valve system of the present flotation control system utilizing a closed center system.
Figure 5:
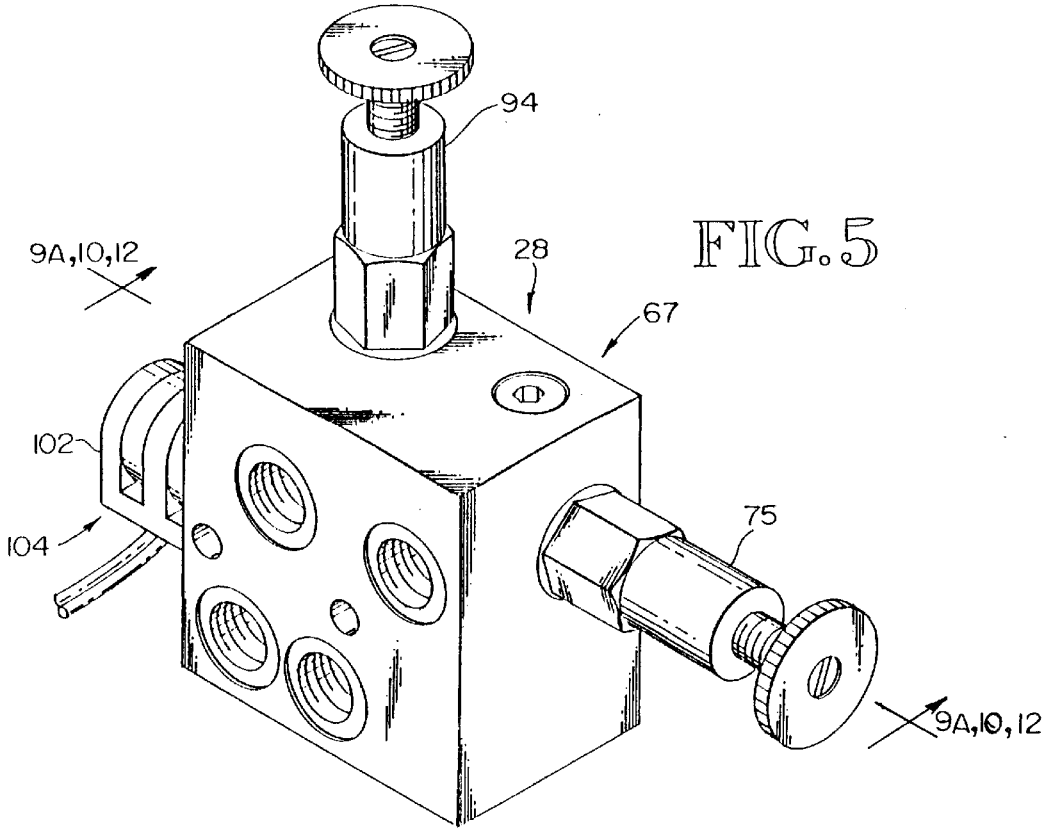
FIG. 5 is a perspective view of the second embodiment of the hydraulic valve system of the present flotation control system utilizing an open center system.
Figure 6:
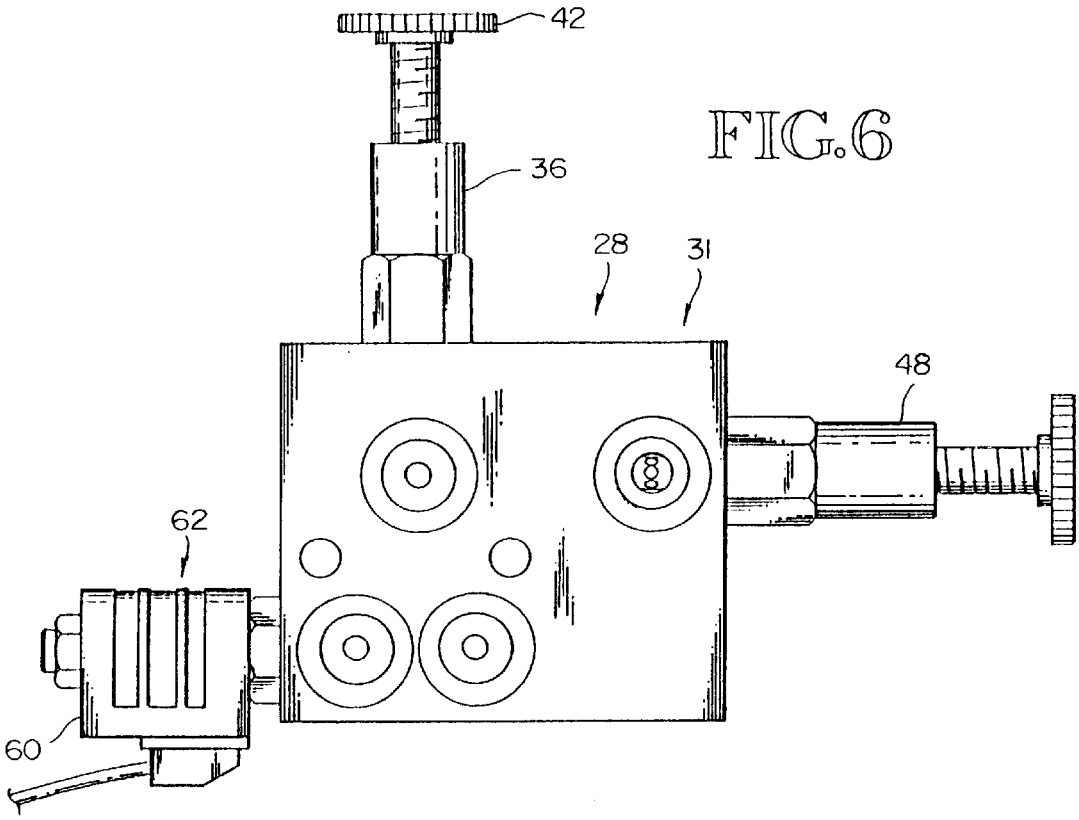
FIG. 6 is a side elevation view of the first embodiment of the hydraulic value system of the present flotation control system utilizing a closed center system.
Figure 6A:
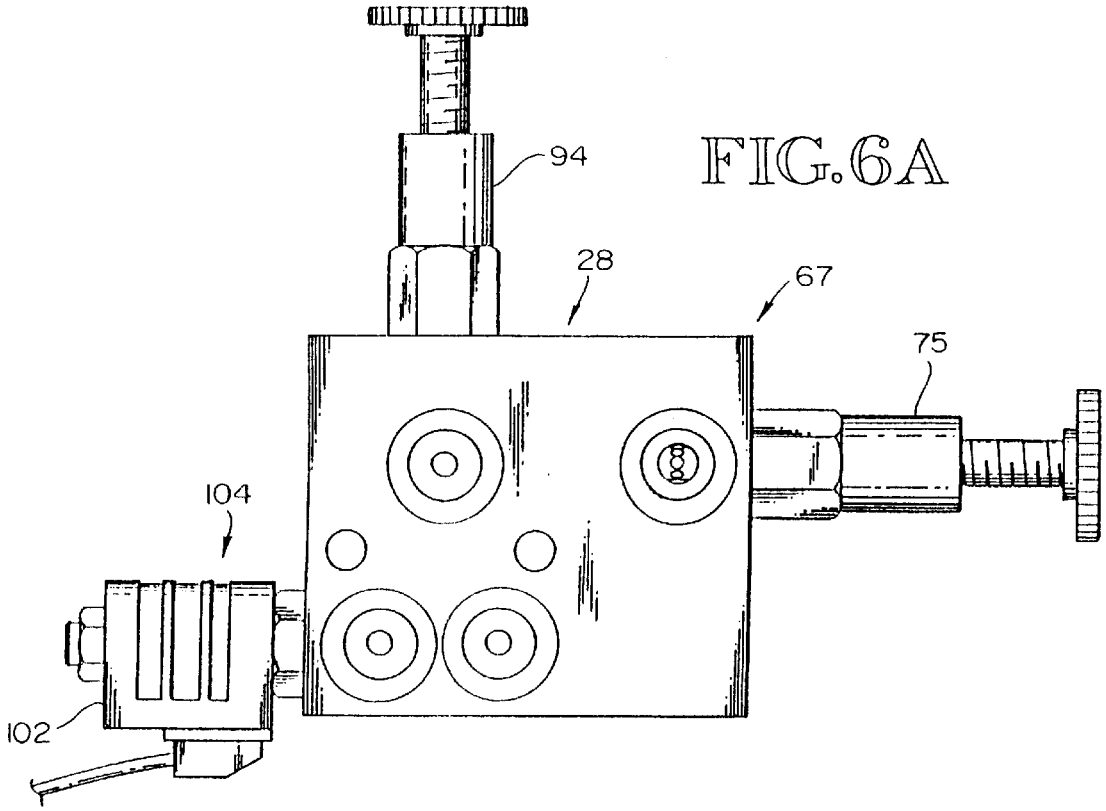
FIG. 6A is a side elevation view of the second embodiment of the hydraulic value system of the present flotation control system utilizing an open center system.

Referring now to FIG. 3 of the drawings there is shown a schematic view of a second embodiment of the present flotation control system utilizing an open center system 67.

Generally, in the second embodiment or open center system 67 of the present flotation control system 16 as shown in FIG. 3, a gear or vane pump 68 is normally utilized to provide constant displacement of hydraulic fluid for the main tractor hydraulic system 70. Any excess hydraulic fluid is directed to the tractor relief valve 71. In the second embodiment of the flotation control system utilizing an open center system 67, the first valve is also a flow restricting or flow dividing means 72 in the form of a valve 74 that divides hydraulic flow from the hydraulic pump 68 of the tractor or brush cutting machine 10, as seen in FIG. 1, to the second valve, pressure reducing valve 75 that accomplishes the work of the system. The pressure reducing valve 48 of the closed center system 31 is the same pressure reducing valve 75 used in the open center system 67. In the open center system 67, the flow restricting or flow dividing means 72 in the form of a valve 74 also generally allows hydraulic fluid to be taken from the main system, the tractor or brush cutter hydraulic system 70 in the present application, and used in the auxiliary system, the hydraulic valve system 28 of the flotation control system 16 in the present application. More specifically, the amount of the hydraulic flow divided from the main system 70 to the auxiliary system 28 for operation of the auxiliary system 28 is regulated by a dial or knob 76 and works as a controlled flow or priority setting valve. In the second embodiment or open center system 67 of the present flotation control system 16, the flow dividing means 72 in the form of a valve 74 receives total pump output from the main system 70 as its hydraulic input. The flow dividing valve 74 receives its input as long as the output from the main system 70 is less than a predetermined adjusted flow. The flow dividing valve 74 delivers a predetermined amount of input to a controlled flow port 78 and the excess of hydraulic flow is directed to an excess flow port 80. This regulated or controlled rate of hydraulic flow is substantially maintained at its predetermined level regardless of whether the controlled 78 and/or excess flow ports 80 are under pressure. The rate of flow through the controlled flow port 78 is determined by the size of the orifice 82, which is adjusted by positioning the dial or knob 76. In the open center system 67 also, flow adjustment by means of varying the orifice 82 size instead of changing a spring load allows the maintenance of a fixed pressure drop across the orifice 82 regardless of changing conditions. Excess flow to the excess flow port 80 can then be bypassed directly back to the main tractor or brush cutter hydraulic system 70 and to the tractor control valve 30, or can be used to operate the independent hydraulic valve system 28 of the flotation control system 16 with little effect on the main tractor hydraulic control system 70.

In both the first and second embodiments utilizing a closed and open center system respectively the hydraulic flow and control is handled very much the same. Both the closed center system 31, as seen in FIG. 2, and the open center system 67, as seen in FIG. 3, utilize an adjustable orifice 40 or 82 to control hydraulic flow as described hereinbefore. The difference between the two systems and embodiments is that in the first embodiment or closed center system 31 the first flow control valve 36 is a cartridge that screws directly into the block 84 of the hydraulic valve system 28 of the present invention to provide hydraulic flow control. In the second embodiment or open center system 67 the first flow restricting or flow dividing means 72 is a separate valve 74 that is positioned in the block 84 of the hydraulic valve system 28 and is connected at its valve inlet 86 to the main tractor hydraulic system 70 and is connected at its valve outlet 88 to the second relief or pressure reducing valve 75, the pressure reducing valve 75 and 48, being the same valve for both the closed 31 and open center systems 67.

Figure 10:
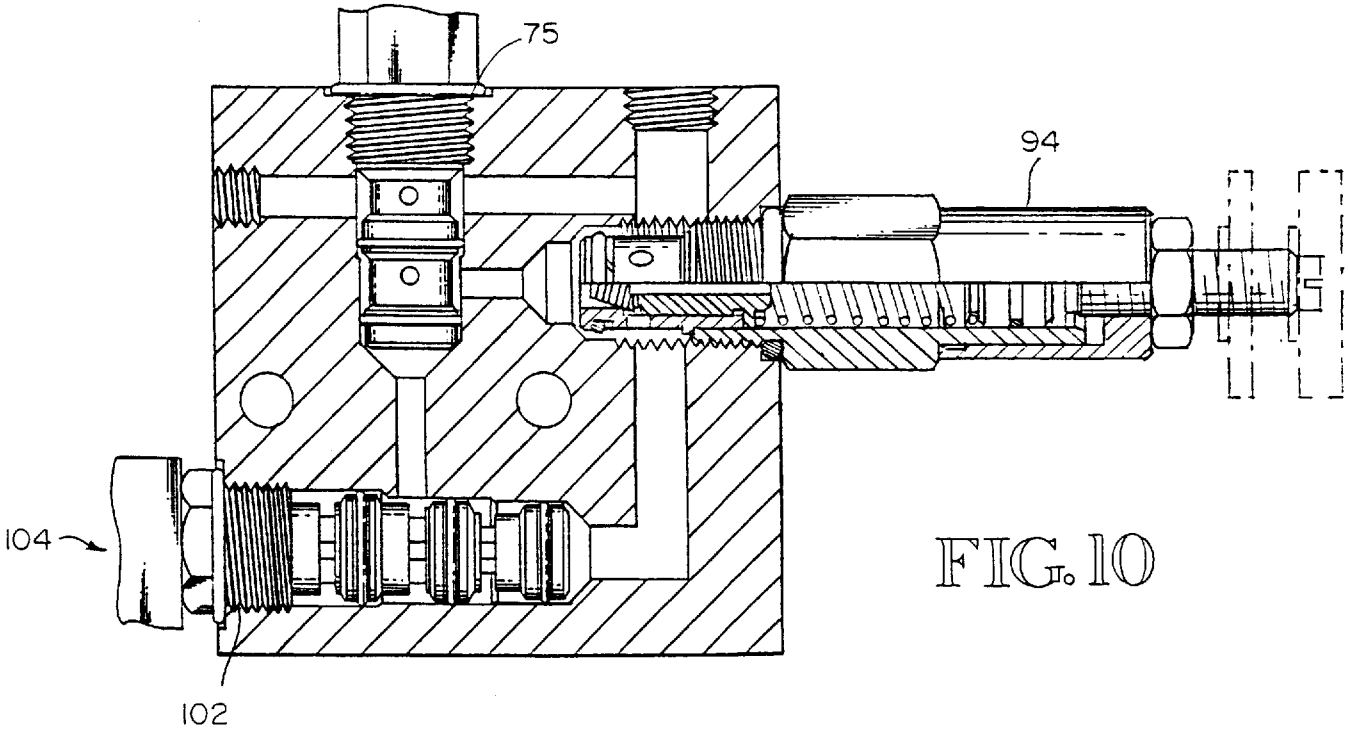
FIG. 10 is a cross-sectional view taken through line 10—10 of FIG. 5 showing the relief valve of the second embodiment utilizing an open center system.

In the second embodiment, hydraulic flow from the controlled flow port 78 of the flow divider valve 74 is thus directed to a second valve, relief and pressure reducing means 90 in the form of a relief and pressure reducing valve 92. In the second embodiment or open center system 67, as seen in FIG. 3, since the system has a constant displacement pump 68 and thus provides constant, demand only hydraulic fluid, a relief valve 94, as seen most clearly in FIG. 10 is positioned prior to the pressure reducing valve 75 to ensure that the pressure reducing valve 75 receives only the hydraulic fluid needed to adjust for a change in pressure received from the cutter or other attachment 29 of the tractor or brush cutting machine 10 as seen in FIG. 1. The pressure reducing and pressure relief means 90 in the form of two valves 94 and 75 allows the pressure of a brush cutter or other attachment 29 against the ground to be sensed and compensated for as in the first embodiment. In the second embodiment or open center system 67 also, as a cutter or other attachment 29 presses against the ground, any change in the ground level such as a depression or hill, is sensed and the cutter or attachment 29 is controlled to float across the upper surface of the ground. Generally, when the pressure presented to the attachment 29 becomes too great, as when encountering a hole or earth mound, the pressure relief valve 94 and pressure reducing valve 75 of the second embodiment of the present flotation control system 16 allows the hydraulic pressure of the hydraulic valve system 28 of the flotation control system 16 to bypass the flotation control system 16 and return through the filter 51 of the main tractor hydraulic system 70 and to the main tractor hydraulic tank 52. More specifically, in the second embodiment of the present invention utilizing an open center system 67 the pressure reducing valve 75 gets its input from a direct-acting relief valve 94. Then in a manner similar to that of the first embodiment, in the second embodiment, hydraulic flow is allowed between the valve inlet 96 and the valve ball 98 of the pressure reducing valve 75 at a predetermined level of hydraulic pressure. Thus, the valve ball 98 is held closed by an adjustable mechanical spring 100, the spring force holding the valve ball 98 closed is opposed by hydraulic pressure tending to open the valve ball 98. When this predetermined level of hydraulic pressure between the valve inlet 96 and valve ball 98 is exceeded, pressure at the valve ball 98 will cause the valve ball 98 to open a small distance, allowing a small part of the oil in the hydraulic valve system 28 to escape and return to the main tractor hydraulic tank 52.

Figure 12:
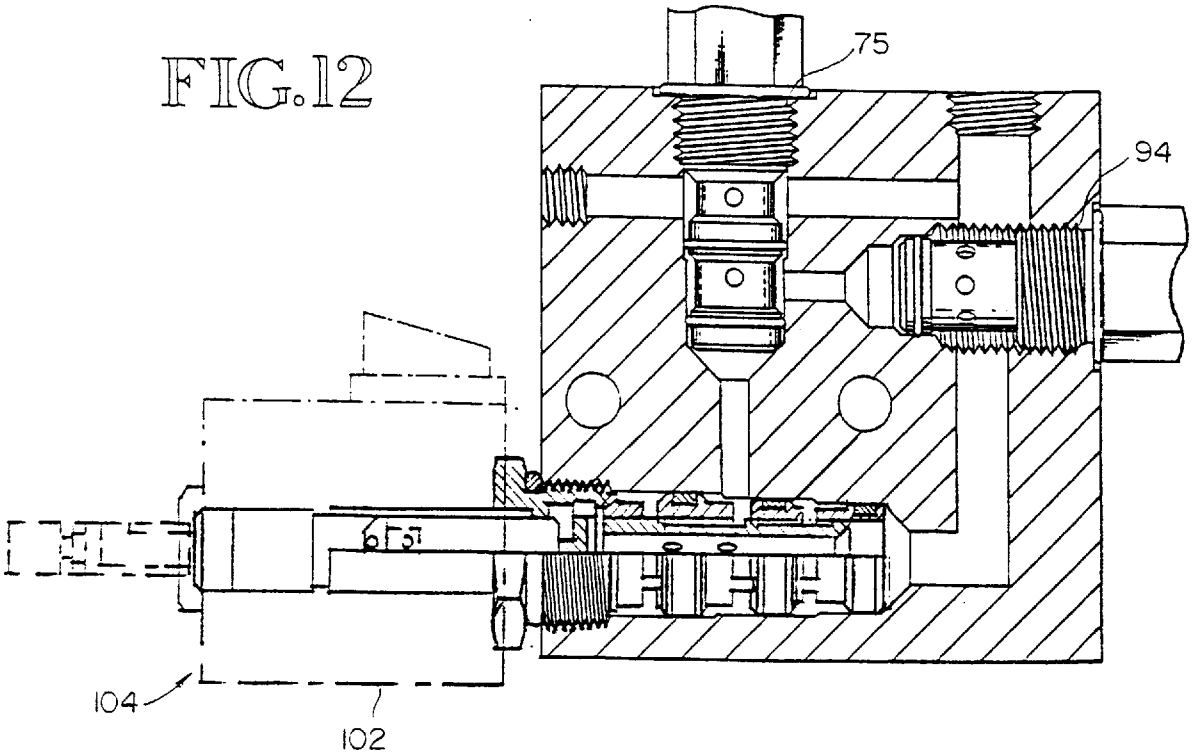
FIG. 12 is a cross-sectional view taken through line 12—12 of FIG. 5 of the directional valve of the second embodiment utilizing an open center system.

In the open center system 67 of the second embodiment, as seen in FIG. 3, a third valve, directional valve 102 also operates as an operational on/off means 104 for the second embodiment of the present invention utilizing an open center system 67. In the second embodiment utilizing an open center system 67 the directional valve 102 is seen most clearly in FIG. 12. Specifically, the four way directional valve 102 has two positions, on or off. In the de-energized mode with the valve magnet 106 de-energized or off, the directional valve 102 allows flow from the pressure reducing valve inlet 96 and back to the main hydraulic tank 52. When the valve magnet 106 is energized, the flow is connected to the hydraulic cylinder 66 of the tractor, thereby allowing the pressure reducing valve 75 to function as described hereinbefore. The directional valve 60 of the closed center system 31 works slightly differently than the directional valve 102 of the open center system 67 in that in the open center system 67 the oil is directed back to the main tractor hydraulic tank 52 when the flotation control system 16 is in neutral, while in the closed center system 31 the directional valve 60 blocks all oil flow from the pressure reducing valve 48 when the flotation control system 16 is off so there is no oil to be directed back to the main tractor hydraulic tank 52. In either the first or second embodiments of the present flotation control system 16 it is within the spirit and scope of the invention to provide the various valves in a single block 84, the outlet 108 of which is connected to the inlet 110 of the boom controlling hydraulic cylinder 66 of the tractor hydraulic system 70 as shown in FIGS. 2 and 3 or to provide the various valves separately anywhere within the tractor operating system 70. It is also within the spirit and scope of the present invention to provide any of the valves used as electrical valves or manual valves.

Having described my invention I claim:

1. A method of flotation control for controlling the pressure that a cutter or other tractor attachment asserts against a ground surface, the tractor having a cab, the method of flotation control comprising the steps of:

a) providing a flow control means for controlling hydraulic fluid flow variably therethrough, the flow control means being a hydraulic flow divider valve;

b) providing pressure reducing means for adjusting hydraulic fluid received from the flow control means, thereby adjusting hydraulic fluid pressure therethrough;

c) providing operational means for allowing the flotation control system to be on or off by connecting or blocking the flow of the hydraulic fluid from the pressure reducing means.

2. The method of flotation control as defined in claim 1 wherein:

the valve of the flow control means is adjustable and pressure compensated.

3. The method of flotation control as defined in claim 1 wherein:

the operational means is a valve.

4. The method of flotation control as defined in claim 3 wherein :

the valve is a four way directional valve.

5. The method of flotation control as defined in claim 1 wherein:

the pressure reducing means is a valve.

6. The method of flotation control as defined in claim 5 wherein:

the valve is adjustable.

7. The method of flotation control as defined in claim 5 wherein:

the valve is a combination relief and pressure reducing valve.

8. A flotation control system for controlling the pressure that a cutter or other boom attachment asserts against a around surface, the flotation control system comprising:

a) flow control means for controlling hydraulic fluid flow variably through the boom;

b) pressure reducing means for adjusting hydraulic fluid received from the flow control means, thereby adjusting hydraulic fluid pressure presented to the boom;

c) operational means for allowing the flotation control system to be on or off by connecting or blocking the flow of the hydraulic fluid from the pressure reducing means.

9. A flotation control system for controlling the pressure that a cutter or other tractor attachment asserts against a ground surface, the tractor having a cab, the flotation control system comprising:

a) flow control means for controlling hydraulic fluid flow variably therethrough, the flow control means being a hydraulic flow divider valve;

b) pressure reducing means for adjusting hydraulic fluid received from the flow control means, thereby adjusting hydraulic fluid pressure therethrough and;

c) operational means for allowing the flotation control system to be on or off by connecting or blocking the flow of the hydraulic fluid from the pressure reducing means.

10. The flotation control system as defined in claim 9 wherein: the valve of the flow control means is adjustable and pressure compensated.

11. The flotation control system as defined in claim 9 wherein:

the operational means is remote controlled, whereby a wired remote allows an on off switch for the flotation control system to be positioned within the cab of the tractor.

12. The flotation control system as defined in claim 9 wherein:

the flotation control system is in a single self contained and removable block.

13. The flotation control system as defined in claim 9 further comprising:

control means for moving the tractor attachment up, down or neutral.

14. The flotation control system as defined in claim 9 wherein:

the flow control means, the pressure reducing means and the operational means are positioned separately within the tractor.

15. The flotation control system as defined in claim 9 wherein: the operational means is a valve.

16. The flotation control system as defined in claim 15 wherein: the valve is a four way directional valve.

17. The flotation control system as defined in claim 9 wherein: the pressure reducing means is a valve.

18. The flotation control system as defined in claim 17 wherein: the valve is adjustable.

19. The flotation control system as defined in claim 17 wherein: the valve is a combination relief and pressure reducing valve.

20. The flotation control system as defined in claim 19 wherein:

the combination relief and pressure reducing valve is remote controlled, whereby a wired remote allows an on off switch for the combination valve to be positioned within the cab of the tractor.

* * * * *